US010526850B2

(12) United States Patent
Chen

(10) Patent No.: US 10,526,850 B2
(45) Date of Patent: Jan. 7, 2020

(54) DRILL BIT CUTTER HAVING SHAPED CUTTING ELEMENT

(71) Applicant: Halliburton Energy Services, Inc., Houston, TX (US)

(72) Inventor: Shilin Chen, Montgomery, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/574,745

(22) PCT Filed: Jun. 18, 2015

(86) PCT No.: PCT/US2015/036424
§ 371 (c)(1),
(2) Date: Nov. 16, 2017

(87) PCT Pub. No.: WO2016/204764
PCT Pub. Date: Dec. 22, 2016

(65) Prior Publication Data
US 2018/0148978 A1 May 31, 2018

(51) Int. Cl.
*E21B 10/55* (2006.01)
*E21B 10/567* (2006.01)
*E21B 10/573* (2006.01)

(52) U.S. Cl.
CPC ..... *E21B 10/5735* (2013.01); *E21B 10/55* (2013.01); *E21B 10/5673* (2013.01)

(58) Field of Classification Search
CPC ... E21B 10/5735; E21B 10/55; E21B 10/5673
See application file for complete search history.

(56) References Cited

U.S. PATENT DOCUMENTS

| | | | |
|---|---|---|---|
| 1,159,087 | A | 11/1915 | Reed |
| 1,790,613 | A | 1/1931 | Gildersleeve et al. |
| 2,297,157 | A | 9/1942 | McClinton |
| 2,634,955 | A | 4/1953 | Johnson |
| 2,886,293 | A | 5/1959 | Carr et al. |
| 2,915,291 | A | 12/1959 | Gulfelt |

(Continued)

FOREIGN PATENT DOCUMENTS

| | | |
|---|---|---|
| CA | 2590282 | 11/2007 |
| CN | 101460701 | 6/2009 |

(Continued)

OTHER PUBLICATIONS

International Search Report and Written Opinion for PCT Patent Application No. PCT/US2015/036424, dated Mar. 18, 2016; 12 pages.

(Continued)

*Primary Examiner* — David J Bagnell
*Assistant Examiner* — Brandon M Duck
(74) *Attorney, Agent, or Firm* — Baker Botts L.L.P.

(57) ABSTRACT

A drill bit cutter having a shaped cutting element is disclosed. The cutter includes a substrate having a fixed portion, and a rotating portion rotatably attached to the fixed portion. The cutter also includes a cutting element secured to the rotating portion of the substrate, the cutting element having a non-circular cross-section in a plane perpendicular to a cutter axis of the rotating cutting element, the cross-section having a radially symmetric shape.

5 Claims, 8 Drawing Sheets

(56) References Cited

U.S. PATENT DOCUMENTS

| | | | | |
|---|---|---|---|---|
| 4,222,446 | A | 9/1980 | Vasek | |
| 4,553,615 | A | 11/1985 | Grainger | |
| 4,751,972 | A | 6/1988 | Jones et al. | |
| 5,467,836 | A * | 11/1995 | Grimes | E21B 10/16 175/401 |
| 5,746,280 | A * | 5/1998 | Scott | E21B 10/16 175/374 |
| 5,799,741 | A | 9/1998 | Kosobrodov et al. | |
| 6,021,859 | A | 2/2000 | Tibbitts et al. | |
| 6,246,974 | B1 | 6/2001 | Jelley et al. | |
| 6,374,926 | B1 | 4/2002 | Goldman et al. | |
| 6,879,947 | B1 | 4/2005 | Glass | |
| 7,243,745 | B2 | 7/2007 | Skeem et al. | |
| 7,762,359 | B1 | 7/2010 | Miess | |
| 7,866,413 | B2 | 1/2011 | Stauffer et al. | |
| 8,037,951 | B2 | 10/2011 | Shen et al. | |
| 8,091,655 | B2 | 1/2012 | Shen et al. | |
| 8,112,258 | B2 | 2/2012 | Durairajan et al. | |
| 8,150,667 | B2 | 4/2012 | Ledgerwood | |
| 8,437,995 | B2 | 5/2013 | Matthews et al. | |
| 8,561,728 | B2 | 10/2013 | Cooley et al. | |
| 8,589,124 | B2 | 11/2013 | Huang | |
| 8,720,611 | B2 | 5/2014 | Chen | |
| 2004/0011159 | A1 | 1/2004 | Meiners et al. | |
| 2005/0015229 | A1 | 1/2005 | Huang | |
| 2005/0133260 | A1 | 6/2005 | Singh et al. | |
| 2005/0133272 | A1 | 6/2005 | Huang et al. | |
| 2006/0100836 | A1 | 5/2006 | Singh | |
| 2007/0093996 | A1 | 4/2007 | Cariveau et al. | |
| 2008/0251293 | A1 | 10/2008 | Mumma et al. | |
| 2010/0059287 | A1 * | 3/2010 | Durairajan | E21B 10/5673 175/420.2 |
| 2010/0211362 | A1 | 8/2010 | Huang et al. | |
| 2011/0015911 | A1 | 1/2011 | Chen | |
| 2011/0031031 | A1 * | 2/2011 | Vempati | C22C 26/00 175/428 |
| 2012/0132471 | A1 | 5/2012 | Zhang et al. | |
| 2012/0152623 | A1 | 6/2012 | Chen | |
| 2012/0152624 | A1 | 6/2012 | Chen | |
| 2013/0068534 | A1 | 3/2013 | Digiovanni et al. | |
| 2013/0087391 | A1 | 4/2013 | Hall et al. | |
| 2013/0167446 | A1 * | 7/2013 | Lin | E21B 10/5673 51/295 |
| 2013/0238245 | A1 | 9/2013 | Chen et al. | |
| 2013/0292185 | A1 | 11/2013 | Knull et al. | |
| 2014/0039854 | A1 | 2/2014 | Huang | |
| 2014/0095134 | A1 | 4/2014 | Cariveau et al. | |
| 2014/0110181 | A1 | 4/2014 | Zhange et al. | |
| 2014/0182947 | A1 * | 7/2014 | Bhatia | E21B 10/46 175/327 |
| 2015/0275584 | A1 * | 10/2015 | Mensa-Wilmot | E21B 10/43 175/431 |
| 2017/0211357 | A1 | 7/2017 | Grosz et al. | |

FOREIGN PATENT DOCUMENTS

| | | | |
|---|---|---|---|
| CN | 203729882 | | 7/2014 |
| CN | 203729882 | U * | 7/2014 |
| EP | 972908 | | 1/2000 |
| WO | 2013/180702 | | 12/2013 |
| WO | 2014/012038 | | 1/2014 |
| WO | 2014/078342 | | 5/2014 |

OTHER PUBLICATIONS

Richard, T. et al.; "Influence of Groove Geometry and Cutter Inclination in Rock Cutting"; ARMA 10-429; 44th U.S. Rock Mechanics Symposium and 5th U.S.-Canada Rock Mechanics Symposium; American Rock Mechanics Association; 9 pages, Jun. 27, 2010.

Chen, Shilin; "The Role of 3-D Rock Chips and Cutting Area Shapes in PDC Bit Design Optimization;" SPE 171833-MS; 19 pages, 2014.

International Search Report and Written Opinion, Application No. PCT/US2014/0331193; 18 pages, Jan. 8, 2015.

Enders, Lanson Adam; "Computation modeling of drill bits : a new method for reproducing bottom hole geometry and a second-order explicit integrator via composition for coupled rotating rigid bodies;" Electronics Theses and Dissertations, UC San Diego; 184 pages, 2007.

Warren et al.; "Drag-Bit Performance Modeling"; SPE Drilling Engineering; vol. 4; No. 2, 119-127; 9 pages, 1989.

International Search Report and Written Opinion, Application No. PCT/US2014/052704; 15 pgs, May 19, 2015.

International Preliminary Report on Patentability of PCT Patent Application No. PCT/US2014/052704, dated Mar. 9, 2017; 10 pages, Mar. 9, 2017.

Glowka, David A.; "Use of Single-Cutter Data in the Analysis of PDC Bit Designs: Part 1—Development of a PDC Cutting Force Model"; SPE; Sandia National Laboratories; 9 pages, Aug. 1989.

Glowka, David A.; "Use of Single-Cutter Data in the Analysis of PDC Bit Designs: Part 2—Development and Use of the PDCWEAR Computer Cope"; SPE; Sandia National Laboratories; 10 pages, Aug. 1989.

Office Action for Canadian Patent Application No. 2955670, dated Jan. 2, 2018; 4 pages.

Office Action for Canadian Patent Application No. 2955670, dated Sep. 17, 2018; 4 pages.

Office Action for Chinese Patent Application No. 201480080323.4, dated Apr. 2, 2018, no English translation; 10 pages.

Office Action for Chinese Patent Application No. 201580079071.8 dated Sep. 19, 2018, no English translation; 11 pages.

Office Action for Canadian Patent Application No. 2985339, dated Oct. 12, 2018; 5 pages.

* cited by examiner

DRILL BIT CUTTER HAVING SHAPED CUTTING ELEMENT

RELATED APPLICATIONS

This application is a U.S. National Stage Application of international Application No. PCT/US2015/036424 filed Jun. 18, 2015, which designates the United States, and is incorporated herein by reference in its entirety.

TECHNICAL FIELD

The present disclosure relates generally to cutters for use in drill bits and other downhole cutting tools.

BACKGROUND

Various types of tools are used to form wellbores in subterranean formations for recovering hydrocarbons such as oil and gas lying beneath the surface. Examples of such tools include rotary drill bits, hole openers, reamers, and coring bits. Rotary drill bits include fixed cutter drill bits, such as polycrystalline diamond (PCD) bits. A drill bit may be used to drill through various levels or types of geological formations. However, as the formation varies with depth or location, for example, from lower compressive strength at one depth/location to higher compressive strength at another depth/location, performance of a cutter may vary.

BRIEF DESCRIPTION OF THE DRAWINGS

A more complete understanding of the present disclosure and its features and advantages thereof may be acquired by referring to the following description, taken in conjunction with the accompanying drawings, in which like reference numbers indicate like features, and wherein.

DETAILED DESCRIPTION

Figure 1:
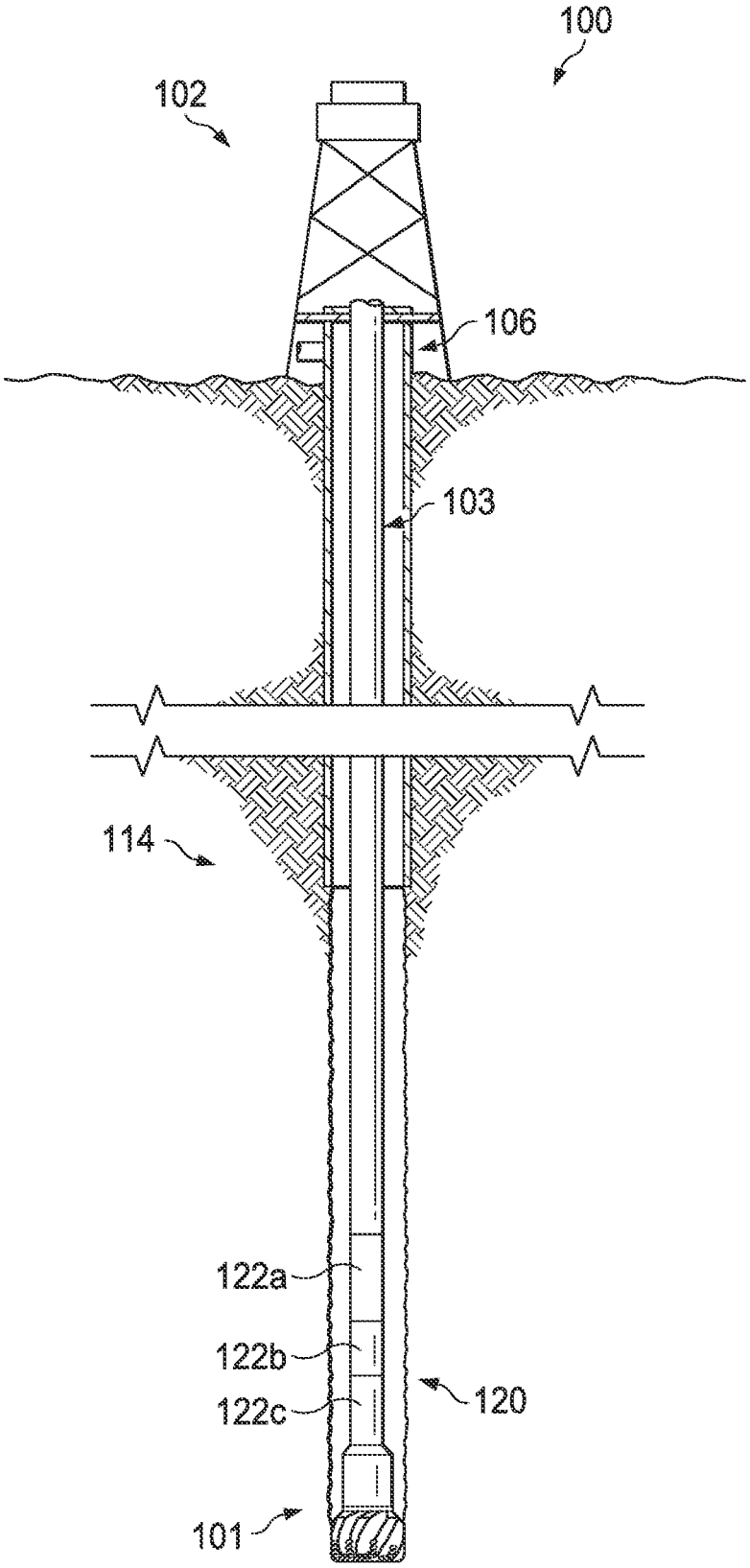
FIG. 1 illustrates an elevation view of an example drilling system.

The present disclosure provides embodiments of a cutter, for a drill bit, having various mechanical attributes for improving cutter performance, such as a specially-shaped (non-circular) cutting elements generally referred to herein as shaped cutting elements. Cutters having these shaped cutting elements may be mounted to a drill bit body and may be optionally rotatable about a cutter axis of the cutter. A plurality of cutters according to this disclosure may be at strategically-selected locations on a drill bit body. Each cutter may include a substrate and a shaped cutting element made of hard cutting material (e.g. polycrystalline diamond) secured on one end of the substrate, such as by brazing or high-temperature pressing. The cutting element may be formed from a superhard material, such as a polycrystalline diamond (PCD) or cubic boron nitride. The cutting element has at least one cutting surface, which is or includes the portion of the cutting element intended to contact the formation during drilling. The cutter is secured to the drill bit body to position the cutting element such that the cutting surface engages a downhole formation during drilling.

In one aspect of the disclosure, the cutting element itself may have a particular geometrical shape other than the generally circular or cylindrical cutting elements on conventional fixed-cutter bits. The particular shape of the cutting element may be other than, and irrespective of, the shape of the substrate to which the cutting element is attached. For instance, a cutter may include a cutting element with a polygonal shape secured to a substrate having a cylindrical shape. A wide variety of different cutting element shapes, and different combinations of cutting element and substrate shape combinations, are also disclosed.

Further, at least a portion of the cutter may be rotatably secured to the bit body so that the cutting element can rotate about a cutter axis passing through the cutting element. In some embodiments, the cutter includes a base portion (which is optionally a substrate-type material) to be attached to the drill bit, and a rotatable substrate portion rotatably secured to the fixed base portion. The rotating substrate portion and the cutting element secured to the rotating substrate portion rotate together about the cutter axis with respect to the fixed base portion. Alternatively, in other embodiments, a shaped cutting element and substrate are non-rotatably secured to the bit body of a fixed cutter drill bit.

In embodiments where cutters have a shaped cutting element (and substrate) and are rotatably secured to the bit body, rotation of the cutting element may allow the cutting element and associated cutter to have an increased useful life, thereby reducing the frequency of cutter replacement. In particular, the ability of the cutting element to rotate with respect to the fixed base portion may reduce cutter wear by exposing a greater length of the cutting surface circumference to the formation over time, versus the cutting edge on a conventional fixed cutter.

Even in embodiments where the shaped cutting elements are not rotatable with respect to the bit body, the shaped, non-rotating cutting element may also have improved properties as compared to a conventional circular cutting element. For example, at the same depth of cut, a shaped, non-circular, non-rotating cutting element may have a larger contact arc length with a formation as compared to a standard circular cutting element. Accordingly, a cutter having a shaped, non-rotating cutting element located close to bit axis may thus take more weight on bit (WOB), which may cause less torque on bit (TOB). A downhole drilling tool including a cutter with a shaped, non-rotating cutting element may thus allow improved tool face control during directional drilling. Features of the present disclosure and its advantages may be further understood by referring to FIGS. 1 through 7.

Cutters of the present disclosure may also be used in a drilling system, such as drilling system 100 in FIG. 1. FIG. 1 illustrates an elevation view of an example drilling system. Drilling system 100 may be configured to provide drilling into one or more geological formations. Drilling system 100 may include a well surface, sometimes referred to as well site 106. Well site 106 may include drilling rig 102 that may have various characteristics and features associated with a land drilling rig. However, downhole drilling tools incorporating teachings of the present disclosure may be satisfactorily used with drilling equipment located on offshore platforms, drill ships, semi-submersibles and drilling barges (not expressly shown in FIG. 1).

Drilling system 100 may include drill string 103 associated with drill bit 101 that may be used to form a wide variety of wellbores or bore holes and that may include cutters of the present disclosure. Bottom hole assembly (BHA) 120 may be formed from a wide variety of components configured to form wellbore 114. For example, components 122*a,* 122*b* and 122*c* of BHA 120 may include, but are not limited to, drill bits (e.g., drill bit 101) drill collars, rotary steering tools, directional drilling tools, downhole drilling motors, drilling parameter sensors for weight, torque, bend and bend direction measurements of the drill string and other vibration and rotational related sensors, hole enlargers such as reamers, under reamers or hole openers, stabilizers, measurement while drilling (MWD) components containing wellbore survey equipment, logging while drilling (LWD) sensors for measuring formation parameters, short-hop and long haul telemetry systems used for communication, and/or any other suitable downhole equipment. The number of components such as drill collars and different types of components 122 included in BHA 120 may depend upon anticipated downhole drilling conditions and the type of wellbore that will be formed by drill string 103 and rotary drill bit 101. Drill bit 101 may be designed and formed in accordance with teachings of the present disclosure and may have many different designs, configurations, and/or dimensions according to the particular application of drill bit 101.

Figure 2:
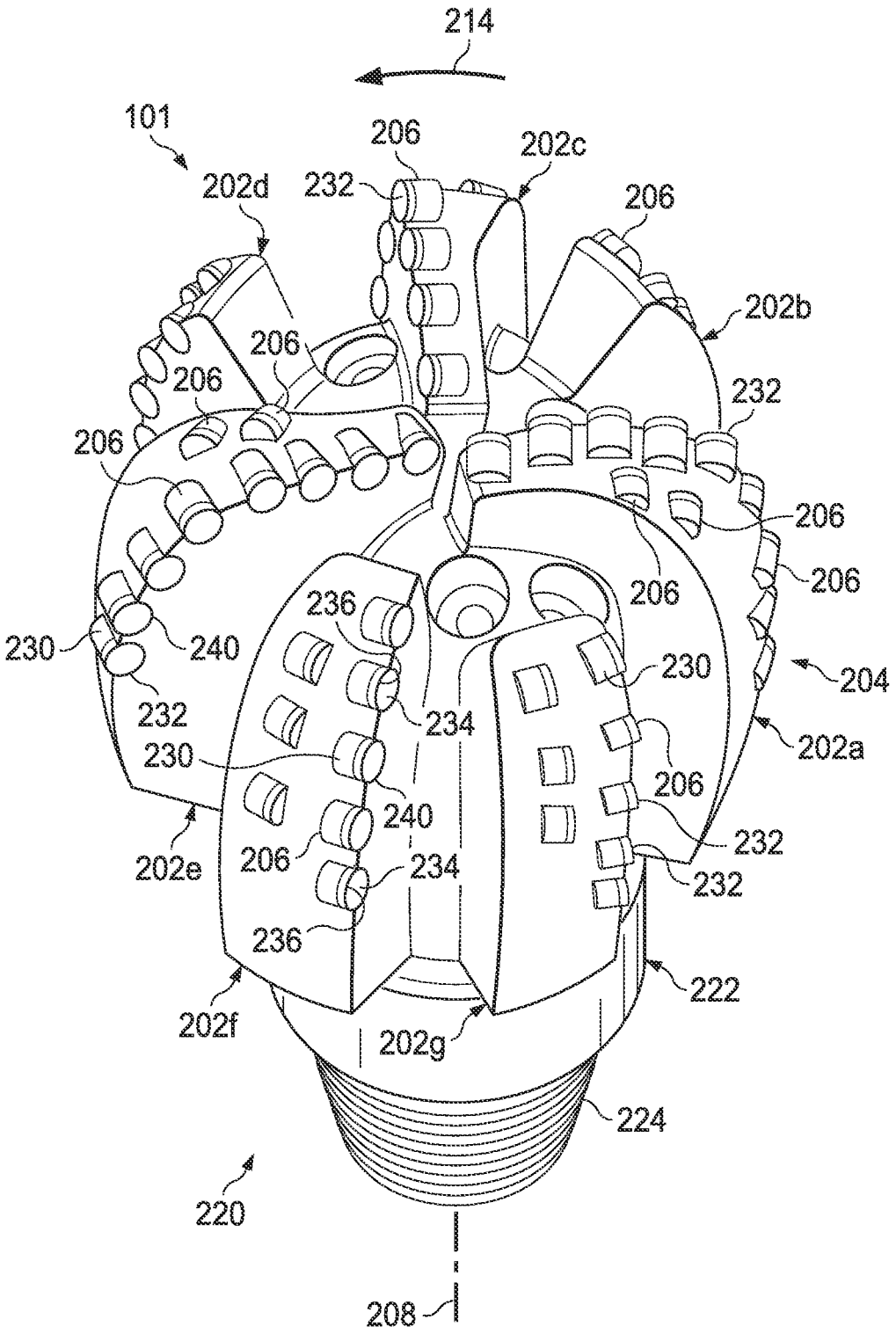
FIG. 2 illustrates an isometric view of an example fixed cutter drill bit.

Cutters of the present disclosure may be used in a downhole tool, such as a fixed cutter drill bit. FIG. 2 illustrates an isometric view of fixed cutter drill bit. Drill bit 101 may be any of various types of fixed cutter drill bits, including PCD bits, drag bits, matrix drill bits, and/or steel body drill bits operable to form a wellbore extending through one or more downhole formations. Other cutting tools that may benefit from the disclosures described herein include, but are not limited to, impregnated drill bits, core heads, coring tools, reamers, and other known downhole drilling tools.

Drill bit 101 may include one or more blades 202 (e.g., blades 202*a*-202*g*) that may be disposed outwardly from exterior portions of rotary bit body 204 of drill bit 101. Rotary bit body 204 may be generally cylindrical and blades 202 may be any suitable type of projections extending outwardly from rotary bit body 204. For example, a portion of blade 202 may be directly or indirectly coupled to an exterior portion of bit body 204, while another portion of blade 202 may be projected away from the exterior portion of bit body 204. Blades 202 formed in accordance with teachings of the present disclosure may have a wide variety of configurations including, but not limited to, substantially arched, helical, spiraling, tapered, converging, diverging, symmetrical, and/or asymmetrical.

Blades 202 and drill bit 101 may rotate about bit axis 208 in a direction defined by directional arrow 214. Blades 202 may include one or more cutters 206 disposed outwardly from exterior portions of each blade 202. For example, a base portion of cutter 206 may be directly or indirectly coupled to an exterior portion of blade 202 while the cutting element of cutter 206 may be projected away from the exterior portion of blade 202. Cutters 206 may be any suitable device configured to cut into a formation, including but not limited to, primary cutters, backup cutters, secondary cutters, or any combination thereof. By way of example and not limitation, cutters 206 may be various types of cutters, compacts, buttons, inserts, and gage cutters, satisfactory for use with a wide variety of drill bits 101.

Cutters 206 may be retained in recesses or cutter pockets 240 located on blades 202 of drill bit 101. A brazing material, welding material, soldering material, adhesive, or other attachment material may be placed between cutter body 230, particularly a fixed base portion, and cutter pockets 240. Cutter 206 may also be removed from cutter pocket 240 by re-heating the brazing material, then physically dislocating cutter 206. A new cutter 206 may then be inserted into cutter pockets 240 and coupled via a braze joint. Cutters 206 may also be coupled to a blade, such as blade 202 of drill bit 101, by use of another securing mechanism. However, cutters 206 may also be coupled to any other component of drill bit 101, such as the top of blade 202 or as a back-up cutter.

Any suitable cutters may include a shaped cutting element. As described below in reference to FIG. 3, a bit face of a drill bit may be divided in to one or more zones. A cutter in any suitable zone may include a shaped cutting element. For example, at least one or all cone cutters may include a shaped cutting element. Additionally, at least one or all gage cutters may include a shaped cutting element. Further, at least one or all shoulder cutters may include a shaped cutting element. Also, at least one or all nose cutters may include a shaped cutting element.

Uphole end 220 of drill bit 101 may include shank 222 with drill pipe threads 224 formed thereon. Threads 224 may be used to releasably engage drill bit 101 with a bottom hole assembly whereby drill bit 101 may be rotated relative to bit axis 208.

Cutters 206 may include cutting element 232 disposed on one end of cutter body 230. Cutting element 232 includes a cutting face that engages adjacent portions of a downhole formation to form a wellbore when used on a drill bit, or performs a similar function on other downhole tools. Cutting element 232 may include cutting face 234 and cutting edge 236. Contact of cutting face 234 and optionally also cutting edge 236 with the formation may form a cutting zone associated with each cutter 206. Cutting element 232 may have a flat or planar cutting face 234, but may also have a curved cutting face 234. Different portions of cutting element 232 may have different surfaces and/or cutting edges with a variety of different properties. For example, different portions of cutting element 232 may have different hardnesses, and/or impact resistance. These properties of cutting element 232 may be based on material used (e.g., diamond grain size), and/or treatment (e.g., leaching).

Cutter body 230, as illustrated in further detail below with reference to FIGS. 4A and 4B, may contain a rotating portion on which cutting element 232 may be disposed, and a fixed base portion, which may be attached to a downhole tool. A substrate portion of cutter body 230 may be formed from tungsten carbide or other suitable materials associated with forming cutters for rotary drill bits. Tungsten carbides may include, but are not limited to, monotungsten carbide (WC), ditungsten carbide ($W_2C$), macrocrystalline tungsten carbide and cemented or sintered tungsten carbide. A substrate portions of cutter body 230 may also be formed using other hard materials, which may include various metal alloys and cements such as metal borides, metal carbides, metal oxides and metal nitrides. Additionally, various binding metals may be included in a substrate portion of cutter body 230, such as cobalt, nickel, iron, metal alloys, or mixtures thereof. Like a substrate portion, a fixed base portion of cutter body 230 may be also formed using any of these materials. A fixed base portion of a cutter body 230 may also be formed from other bit body materials, such as steel, a steel alloy, carbide (e.g., tungsten carbide, silicon carbide, etc.).

For some applications, cutting element 232 may be formed from substantially the same materials as the substrate. In other applications, cutting element 232 may be formed from different materials than the substrate. Examples of materials used to form cutting element 232 may include PCD, including synthetic polycrystalline diamonds, thermally stable polycrystalline diamond (TSP), and other suitable materials.

To form cutting element 232, a rotating substrate portion may be placed proximate to a layer of ultra-hard material particles, e.g., diamond particles, and subjected to high temperature and pressure to result in recrystallization and formation of a polycrystalline material layer, e.g. PCD layer. Cutting element 232 and a rotating substrate portion may be formed as two distinct components of the cutter 206. Cutting element 232 and a rotating substrate portion may alternatively be integrally formed. Cutting element 232 may include different cutting edges and/or cutting faces. Properties of cutting edges and cutting faces of cutting element 232 may be designed based on a characteristic of the formation to be cut by the drill bit. Further, cutting element 232 may have sections (e.g., cutting edges and/or cutting faces) with a variety of different cutting face properties (e.g., hardnesses, and/or impact resistance). These cutting face properties may be based on material used (e.g., diamond grain size), or treatment (e.g., leaching). Although shown in FIGS. 5A-7B below with particular numbers of different cutting edge or cutting face properties, cutting element 232 may have any number of cutting edge or cutting face properties. Examples of cutting edges or cutting faces that may be included on cutter 232 are discussed with reference to FIGS. 5A-7B below.

Figure 3:
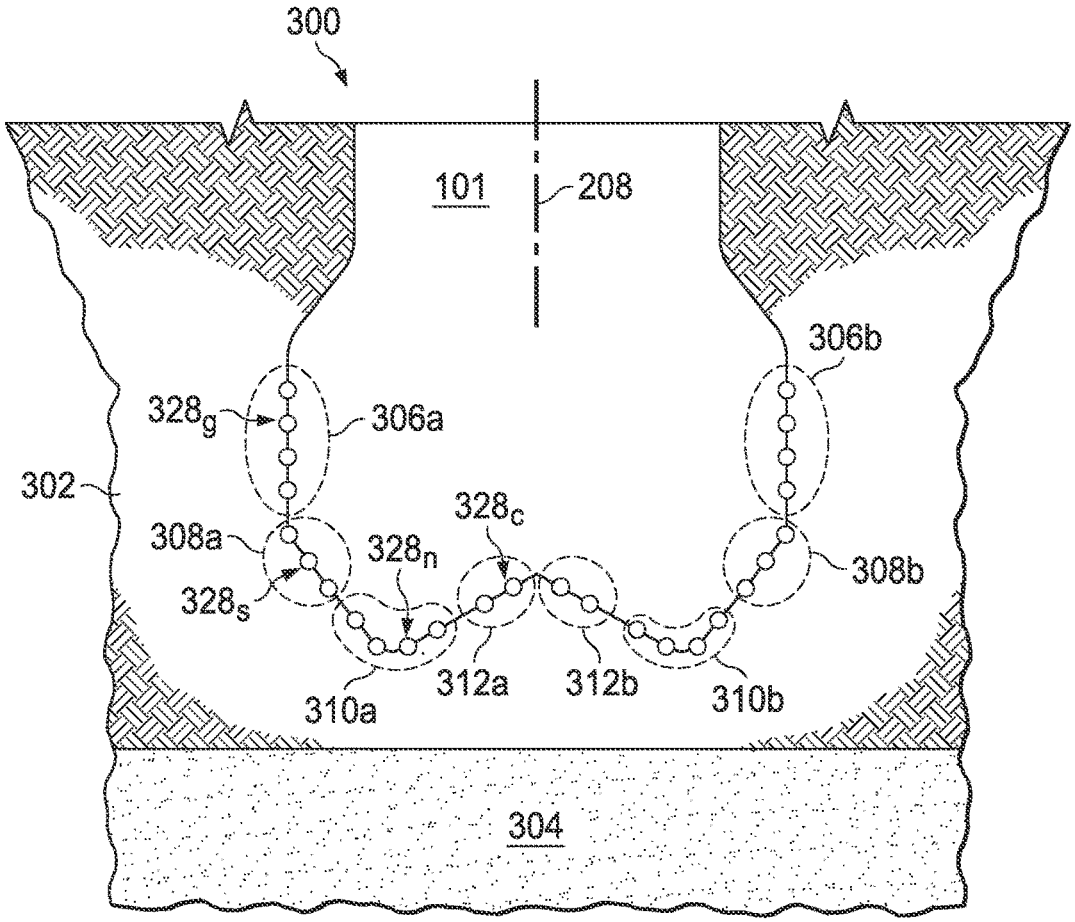
FIG. 3 illustrates a drawing in section and in elevation with portions broken away showing a drill bit drilling a wellbore through a first downhole formation and into an adjacent second downhole formation.

FIG. 3 illustrates a drawing in section and in elevation with portions broken away showing a drill bit, illustrated above in FIGS. 1 and 2, drilling a wellbore through a first downhole formation and into an adjacent second downhole formation. Exterior portions of blades (not expressly shown in FIG. 3) and cutters 328 may be projected rotationally onto a radial plane to form bit face profile 300. As illustrated, formation layer 302 may be described as "softer" or "less hard" when compared to downhole formation layer 304. As shown in FIG. 3, exterior portions of drill bit 101 that contact adjacent portions of a downhole formation may be described as a "bit face." Bit face profile 300 of drill bit 101 may include various zones or segments. Bit face profile 300 may be substantially symmetric about bit axis 208 due to the rotational projection of bit face profile 300, such that the zones or segments on one side of bit axis 208 may be substantially similar to the zones or segments on the opposite side of bit axis 208.

For example, bit face profile 300 may include gage zone 306*a* located opposite gage zone 306*b*, shoulder zone 308*a* located opposite shoulder zone 308*b*, nose zone 310*a* located opposite a nose zone 310*b*, and cone zone 312*a* located opposite a cone zone 312*b*. Cutters 206 included in each zone may be referred to as cutters of that zone. For example, cutters $\mathbf{328}_g$ included in gage zones 306 may be referred to as gage cutters, cutters $\mathbf{328}_s$ included in shoulder zones 308 may be referred to as shoulder cutters, cutters $\mathbf{328}_n$ included in nose zones 310 may be referred to as nose cutters, and cutters $\mathbf{328}_c$ included in cone zones 312 may be referred to as cone cutters.

Cone zones 312 may be formed on exterior portions of each blade (e.g., blades 202 as illustrated in FIG. 2) of drill bit 101, adjacent to and extending out from bit axis 208. Cone zones 312 may include convex portions and/or concave portions. Nose zones 310 may be generally convex and may be formed on exterior portions of each blade of drill bit 101, adjacent to and extending from each cone zone 312. Shoulder zones 308 may be formed on exterior portions of each blade 202 extending from respective nose zones 310 and may terminate proximate to a respective gage zone 306. As shown in FIG. 3, the area of bit face profile 300 may depend on cross-sectional areas associated with zones or segments of bit face profile 300 rather than on a total number of cutters, a total number of blades, or cutting zones per cutter. FIG. 3 is for illustrative purposes only and modifications, additions or omissions may be made to FIG. 3 without departing from the scope of the present disclosure. For example, the actual locations of the various zones with respect to the bit face profile may vary from the depiction in FIG. 3.

Figure 4A:
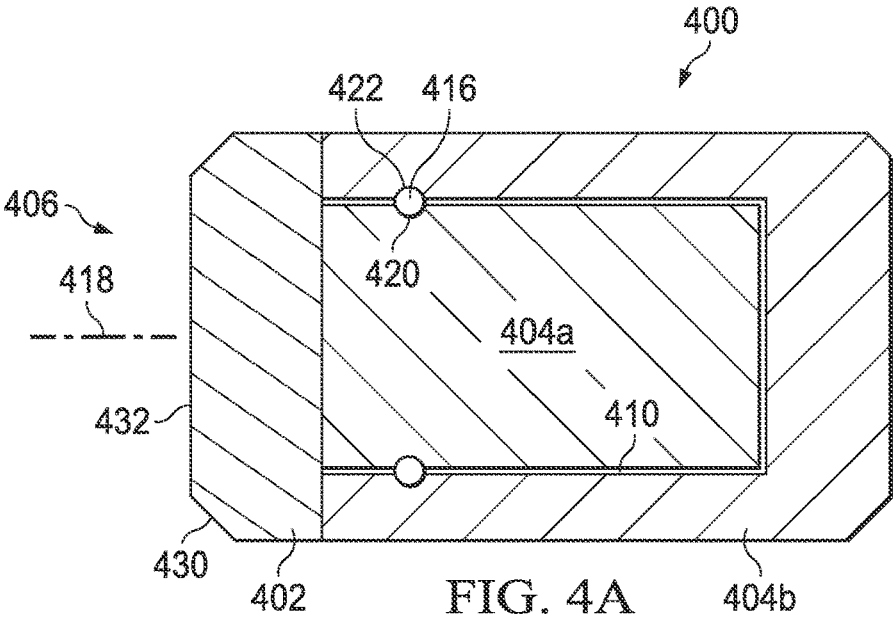
FIG. 4A illustrates a cross-sectional side view of an example rotating cutter with a shaped cutting element.
Figure 4B:
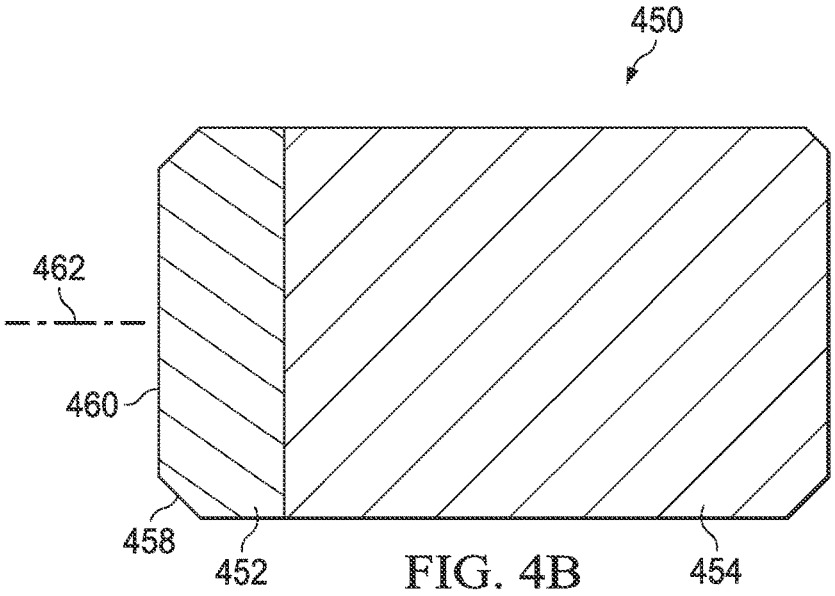
FIG. 4B illustrates a cross-sectional side view of an example non-rotating cutter with a shaped cutting element.

FIG. 4A illustrates a cross-sectional side view of an example rotating cutter with a shaped cutting element. There are numerous ways that a rotating portion of a substrate may be rotatably affixed to a fixed base portion. For example, as depicted in FIG. 4A, rotating cutter 400 includes fixed base portion 404*b* and associated shaped cutting element 402 coupled to rotating substrate portion 404*a*. Fixed base portion 404*b* may include a generally cylindrical internal recess 410. Recess 410 may be configured to receive rotating substrate portion 404*a*. Rotating substrate portion 404*a* may be selected to fit within a recess defined within fixed base portion 404*b*. Rotating substrate portion 404*a* may be configured to support shaped cutting element 402 and rotate with respect to fixed base portion 404*b* within recess 410.

Retainer 416 may retain rotating substrate portion 404*a* in associated recess 410 while allowing rotating substrate portion 404*a* to rotate with respect to fixed base portion 404*b*. Retainer 416 may include any retention mechanism or device configured to allow rotating substrate portion 404*a* to rotate about its cutter axis 418 with respect to fixed base portion 404*b*. For example, bearings or retaining balls, may be used between rotating substrate portion 404*a* and recess 410 to secure rotating substrate portion 404*a* within recess 410. Retainer 416 may include retaining balls or other ball bearing mechanisms disposed in an annular array. The annular array may be formed, for example, by an inner ball race 420 in rotating substrate portion 404*a* and outer ball race 422 in adjacent interior portions of recess 410 of fixed base portion 404*b*. When cutting assembly 406 is installed in fixed base portion 404*b*, inner ball race 420 and outer ball race 422 may be substantially aligned, and the space defined between inner race 420 and outer race 422 may be generally occupied by the ball bearings.

In addition to or in place of the ball bearings described directly above, retainer 416 may include any other suitable mechanical interlocking device that rotatably secures rotating substrate portion 404*a* within recess 410. For example, retainer 416 may include one or more pins (not expressly shown in FIG. 4A) that rotatably secures rotating substrate portion 404*a* within recess 410. Moreover, multiple retention mechanisms or retainers 416 may be used. Retainer 416 may be made of any material capable of withstanding compressive forces acting while the cutting assembly 406 engages the formation. For example, retainer 416 may be made of steel, a steel alloy, carbide (e.g., tungsten carbide, silicon carbide, etc.), or any other suitable material. When inserted, retainer 416 may prevent disengagement of rotating substrate portion 404*a* from fixed base portion 404*b*. Furthermore, retainer 416 may permit rotating substrate portion 404*a* to rotate around cutter axis 418. Although a particular configuration of fixed base portion 404*b* and rotating substrate portion 404*a* is depicted in FIG. 4A, any suitable retainer may be used to rotatably secure each rotating substrate portion 404*a* in associated recess 410.

A rotating substrate portion may be affixed to a fixed substrate portion in any suitable configuration. For example, a recess may be defined within a rotating substrate portion, and such a recess may be configured to receive a fixed base portion. In this implementation, a retainer similar to retainer 416 may be used to secure a fixed base portion within a recess in a stable substrate portion. An inner ball race may be defined on a fixed base portion, rather than on a rotating substrate portion. Similarly, an outer ball race may be defined on a rotating substrate portion rather than on a fixed base portion. Alternatively, any other suitable retainer or retention mechanism may be used.

For some applications, bearing surfaces (not expressly shown in FIG. 4A), may facilitate rotation of a rotating cutter. For example, bearing surfaces may be disposed on exterior portions of a rotatable substrate and interior portions of a recess formed within a fixed base portion. Bearing surfaces associated with mounting a rotatable substrate within a fixed base portion may be formed as integral components of rotatable substrate and/or fixed base portion. Although a particular configuration of bearing surfaces is described, any suitable configurations of bearing surfaces may be used to facilitate rotation of one or more rotating substrate portions 404*a* in associated recesses 410.

Shaped cutting element 402 may be disposed on one end of rotating substrate portion 404*a*. Shaped cutting element 402 may be similar to cutting element 232 discussed with reference to FIG. 2, and thus may be configured to cut through a formation during drilling operations. Shaped cutting element 402 may have a non-circular cross-section in a plane perpendicular to cutter axis 418. Further, shaped cutting element 402 may include different edge configurations for cutting edges 430 and/or cutting face properties of cutting face 432. For example, cutting edge 430 may be configured with a chamfer or a bevel. Moreover, different portions of shaped cutting element 402 may have different cutting face properties. For example, different portions of cutting element may be formed with different materials or have different treatments applied. Accordingly, different portions of shaped cutting element 402 may have different hardness and/or impact resistance values. These properties may be based, at least in part, on a material used to form shaped cutting element 402 (e.g., diamond grain size), or a treatment applied to shaped cutting element 402 (e.g., leaching).

A shaped cutting element may also be affixed to a non-rotating cutter. FIG. 4B illustrates a cross-sectional side view of an example non-rotating cutter with a shaped cutting element. Cutter 450 includes substrate portion 454 and associated shaped cutting element 452 coupled to substrate portion 454. Shaped cutting element 452 may be similar to cutting element 232 discussed with reference to FIG. 2, and thus may be configured to cut through a formation during drilling operations. Shaped cutting element 452 may have a non-circular cross-section in a plane perpendicular to cutter axis 462. Further, shaped cutting element 452 may include different edge configurations for cutting edges 458 and/or cutting face properties of cutting face 460. For example, cutting edge 458 may be configured with a chamfer or a bevel. Moreover, different portions of shaped cutting element 452 may have different cutting face properties. For example, different portions of cutting element may be formed with different materials or have different treatments applied. Accordingly, different portions of shaped cutting element 452 may have different hardness and/or impact resistance values. These properties may be based, at least in part, on a material used to form shaped cutting element 452 (e.g., diamond grain size), or a treatment applied to shaped cutting element 452 (e.g., leaching).

Figure 5A:
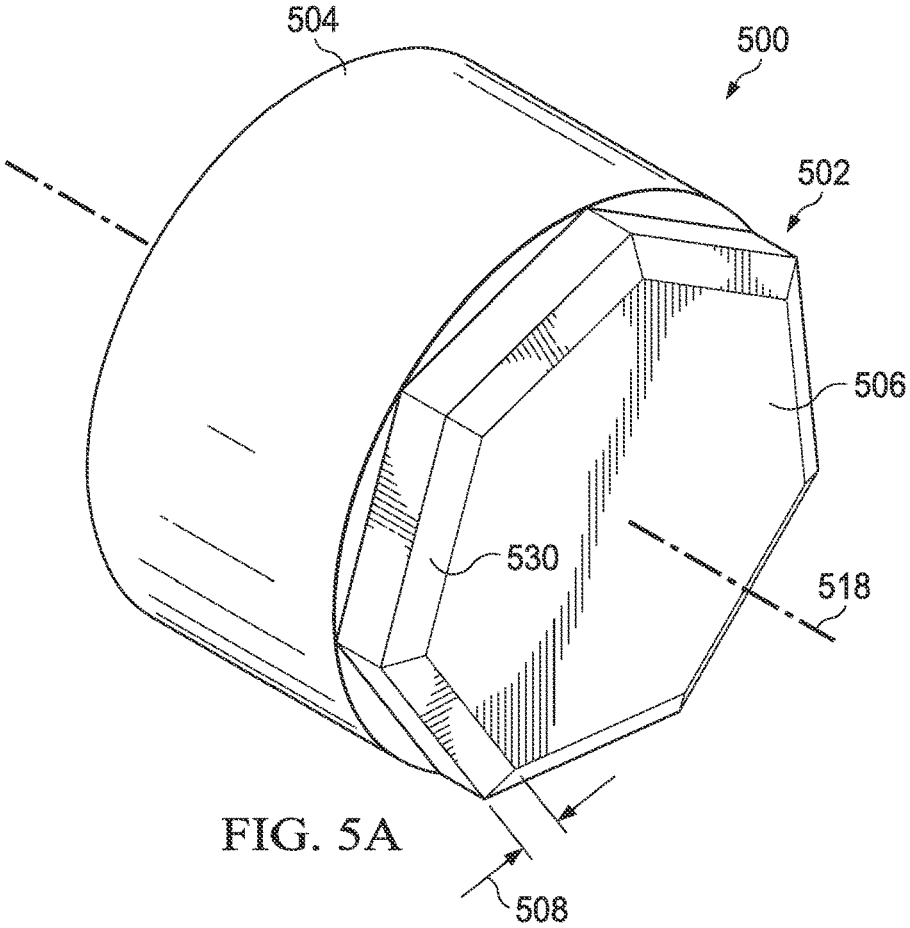
FIG. 5A illustrates an isometric view of an example cutter.

FIG. 5A illustrates an isometric view of an example cutter. Cutter 500 may include substrate 504 and shaped cutting element 502. Shaped cutting element 502 may have a non-circular cross-section. As described below in further detail with reference to FIGS. 6A-7B, interactions between a formation and shaped cutting element 502 may promote rotation of cutters 500 around cutter axis 518.

A cross section through a shaped cutting element in a plane perpendicular to the cutter axis of a cutter may have a variety of shapes. For example, shaped cutting elements may have a regular polygonal cross-section. For the purposes of the present disclosure, a regular polygon may refer to a polygon where all the sides have approximately the same length and where all of the interior angles are approximately equal. As depicted on exemplary cutter 500, shaped cutting element 502 has a heptagonal cross-section. A shaped cutting element may have a cross-section corresponding to a higher order regular polygon, including regular polygons having between 6 and 36 sides. A shaped cutting element may have either a convex cross-section or a concave cross-section. For the purposes of the present disclosure, a cross-section may be concave if one or more interior angles of the cross-section are greater than approximately 180 degrees. Similarly, for the purposes of the present disclosure, a cross-section including both concave portions and convex portions may be referred to as concave. Shaped cutting element 502 may be radially symmetric around cutter axis 518. Shaped cutting element 502 may also have a cross section including any suitable number of teeth, as described with reference to FIG. 5C. Shaped cutting element 502 may be circumscribed by a cross-section of substrate 504. Accordingly, because shaped cutting element 502 may have a non-circular cross-section, shaped cutting element 502 may underlap substrate 504.

A shaped cutting element may include one or more types of cutting edges. For example, shaped cutting element 502 includes chamfered cutting edge 530. Although shaped cutting element 502 is illustrated with a chamfered edge with a particular angle relative to cutting surface 506 and a particular chamfer width 508, a shaped cutting element may generally have a chamfered edge with any suitable angle relative to the cutting surface and any suitable chamfer width. Further, in addition to or in place of a chamfered edge, a shaped cutting element may have any number of beveled edges, non-planar edges, and planar edges. Similar to the chamfered edges, other edges such as beveled edges, non-planar edges, and planar edges may have any suitable size.

Moreover, a shaped cutting element, or portions of a shaped cutting element, may be formed from different materials. Accordingly, different cutting faces of a shaped cutting element may have different cutting face properties. For example, different cutting faces may have different hardnesses and/or impact resistances. These properties may be based, at least in part, on a material used to form shaped cutting element 502 (e.g., diamond grain size), or a treatment applied to shaped cutting element 502 (e.g, leaching). The edge configuration of a shaped cutting element may be selected based, at least in part, on impact resistance and drilling efficiency. For example, a large chamfer size may increase impact resistance, and thus increase bit life. Similarly, a large chamfer size may decrease drilling efficiency. Although particular properties of shaped cutting element are depicted in FIG. 5A, a shaped cutting element may have any suitable shape, edge configuration, or other cutting element properties.

Shaped cutting elements may have many different shapes, edge configurations, and/or cutting face properties. Further, as described in further detail below with reference to FIG. 5C, shaped cutting elements may include a non-polygonal shape in place of the polygonal shape illustrated in FIG. 5A.

Figure 5B:
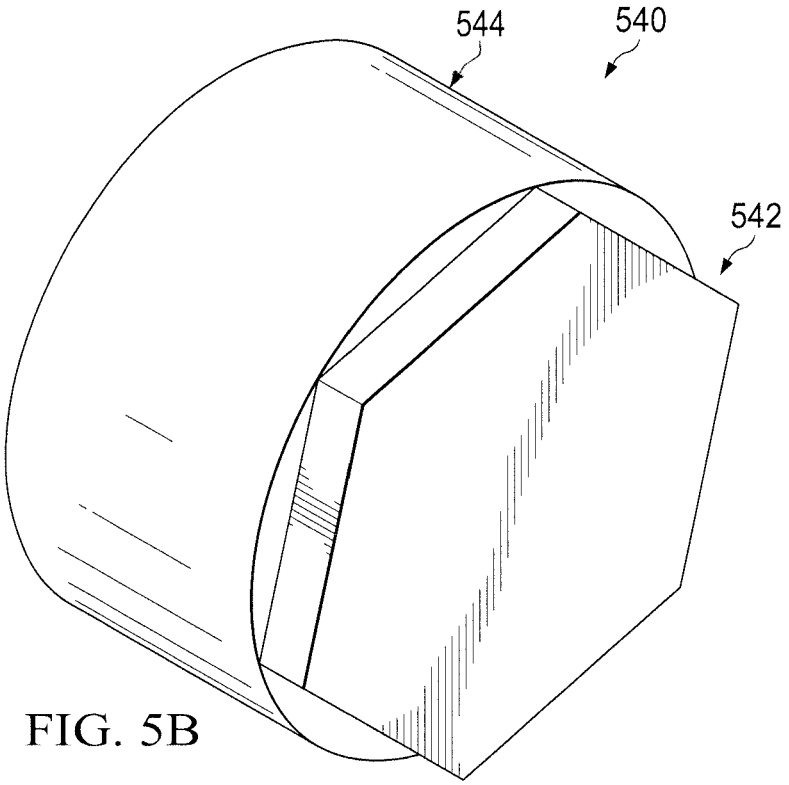
FIG. 5B illustrates an isometric view of an example cutter.

FIG. 5B illustrates an isometric view of an example cutter. Cutter 540 may have similar features to cutter 500, described above with reference to FIG. 5A. For example, cutter 540 may include substrate 544 and shaped cutting element 542. Shaped cutting element 542 may have a regular polygonal cross-section. Shaped cutting element 542 has a planar cutting edge rather than a chamfered cutting edge. Accordingly, cutter 540 may have a larger impact resistance than cutter 500, described above with references to FIG. 5A. Correspondingly, cutter 540 may have a lower drilling efficiency than cutter 500.

Figure 5C:
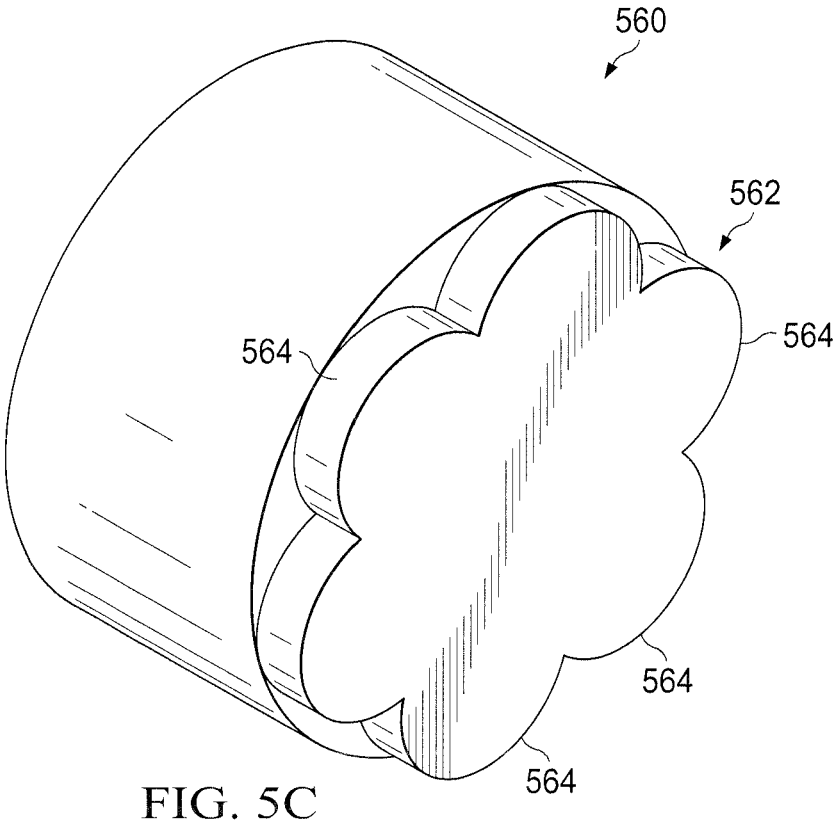
FIG. 5C illustrates an isometric view of an example cutter.

FIG. 5C illustrates an isometric view of an example cutter. Shaped cutting element 562 has a non-polygonal, concave cross-section. Specifically, shaped cutting element 562 includes teeth 564 spaced around the circumference of shaped cutting element 562. Teeth on a shaped cutting element may be rounded, such as a segment or sector of a circle or ellipse. A circle segment is the area between a chord of a circle and an arc subtended by that chord. A circle sector is the area enclosed by two radii of a circle and the arc between those two radii. However, any suitable shape of tooth may be used, such as regular polygons or other polygons. Teeth 564 may be arranged around the edges of shaped cutting elements such that symmetry around the cutter axis of a cutter may be maintained. Although shaped cutting element 562 is illustrated with a planar edge, shaped cutting element 562 may include any number of chamfered edges, beveled edges, non-planar edges, and planar edges. Furthermore, shaped cutting element 562 may include any suitable sizes for any chamfered edges, beveled edges, non-planar edges, and planar edges. Additionally, different cutting faces may have different cutting face properties. For example, different cutting faces may have different hardnesses and/or impact resistances. These properties may be based, at least in part, on a material used to form cutting element 562 (e.g., diamond grain size), or a treatment applied to cutting element 562 (e.g, leaching).

As a cutter moves through a formation, a shaped cutting element contacts the formation. As a result, the shaped cutting element may incur drilling forces. For shaped cutting elements attached to rotating substrates, the drilling forces incurred by a shaped cutting element may promote rotation of the cutter. A shaped, non-rotating cutter located close to bit axis may thus take more weight on bit (WOB), which may cause less torque on bit (TOB), allowing for improved tool face control.

Figure 6A:
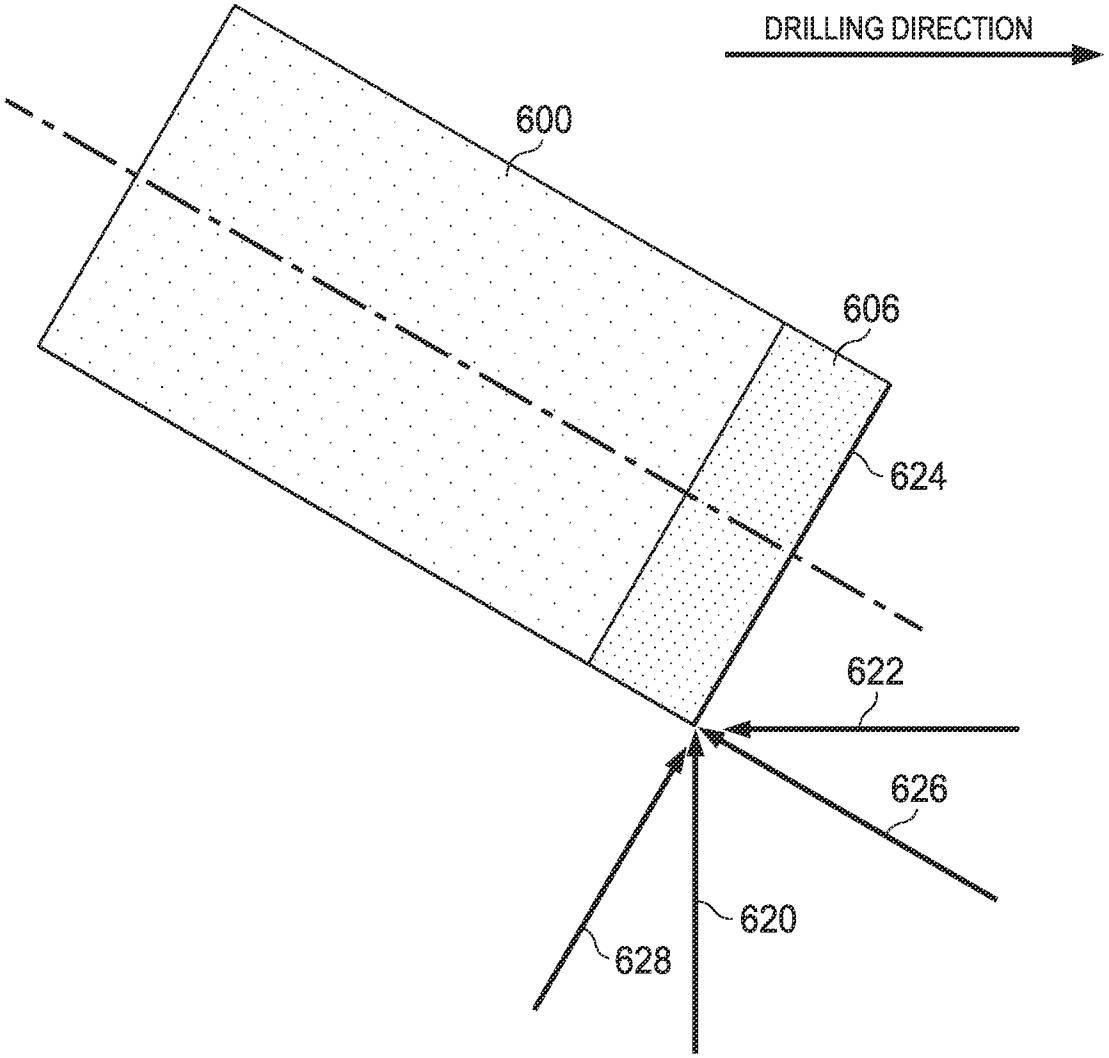
FIG. 6A illustrates a cross-sectional side view of an exemplary cutter, including associated drilling forces.

FIG. 6A illustrates a cross sectional side view of an exemplary cutter, including associated drilling forces. Cutter 600 includes shaped cutting element 606. Shaped cutting element 606 includes cutting face 624. As cutter 600 moves through a formation in the drilling direction, shaped cutting element 606 may incur drilling forces, such as penetration force 620 and drag force 622. Penetration force 620 may act toward a bit axis of a drill bit. Drag force 622 may act perpendicular to penetration force 620 and in the opposite direction as the drilling direction of cutter 600. Penetration force 620 may be projected into the plane of cutting face 624, resulting in radial force 628. Similarly, drag force 622 may be projected into a plane normal to cutting face 624, resulting in normal force 626.

Drag force 622 and penetration force 620 may depend on cutter geometry coefficients ($K_d$) and ($K_p$), which may be functions of back rake angle, side rake angle, and profile angle of cutter 600. Further, drag force 622 and penetration force 620 may additionally depend on rock compressive strength (σ), area (A) of the cutting zone and contact length (L) of the cutting zone. Drag force 622 and penetration force 620 may be calculated as expressed by the equations:

$$F_d = K_d * \sigma * f(A, L)$$

$$F_p = K_p * \sigma * f(A, L)$$

Drilling forces may vary if, for example, cutting zones of cutters, cutter geometry coefficients, or rock compressive strength at the location of a cutter, vary between cutters. For example, cutting forces may depend on cutter locations on the blade of the drill bit, rake angles, formation compressive strength, rate of penetration (ROP), weight on bit (WOB), and/or rotations per minute (RPM). Drag forces and penetration forces may be incurred by one or more individual cutters. Each drag force and penetration force on a cutter may be decomposed into horizontal and vertical components based on the relative location and orientation of a cutter in a wellbore. The sum of vertical components of these forces may be used to estimate WOB. Further, drag forces may be multiplied by their respective moment arms to compute torque on bit (TOB).

Figure 6B:
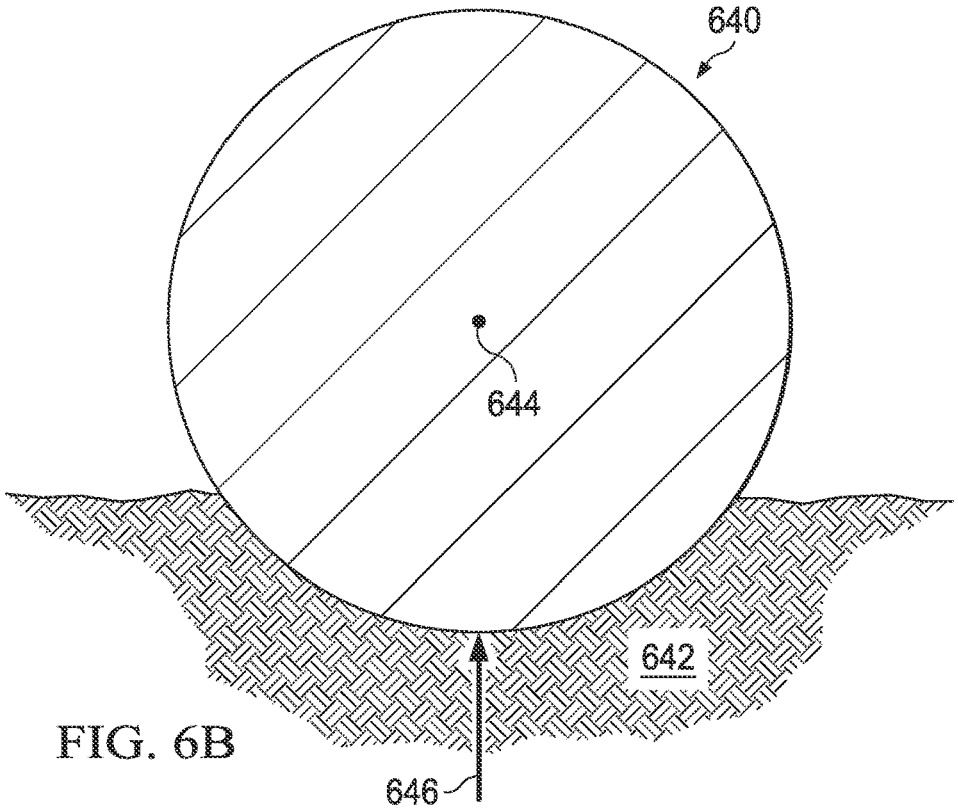
FIG. 6B illustrates a cross-sectional front view of a cutting element drilling a downhole formation.

FIG. 6B illustrates a cross-sectional front view of a cutting element drilling a downhole formation. During drilling, cutter 640 may move through formation 642. Cutters having a cutting element with a circular cross section incur a zero or very small torque around a cutter axis (e.g., cutter axis 644 of cutter 640) when engaging with a formation. As described above with reference to FIG. 6A, as a cutter moves through a formation, the cutter may incur various drilling forces, including one or more radial forces. Cutters having circular cross-sections (such as cutter 640) may incur a single radial force. For example, cutter 640 may incur radial force 646. Radial force 646 may act substantially toward cutter axis 644. Accordingly, radial force 646 typically generates a zero or very small torque around cutter axis 644.

Figure 6C:
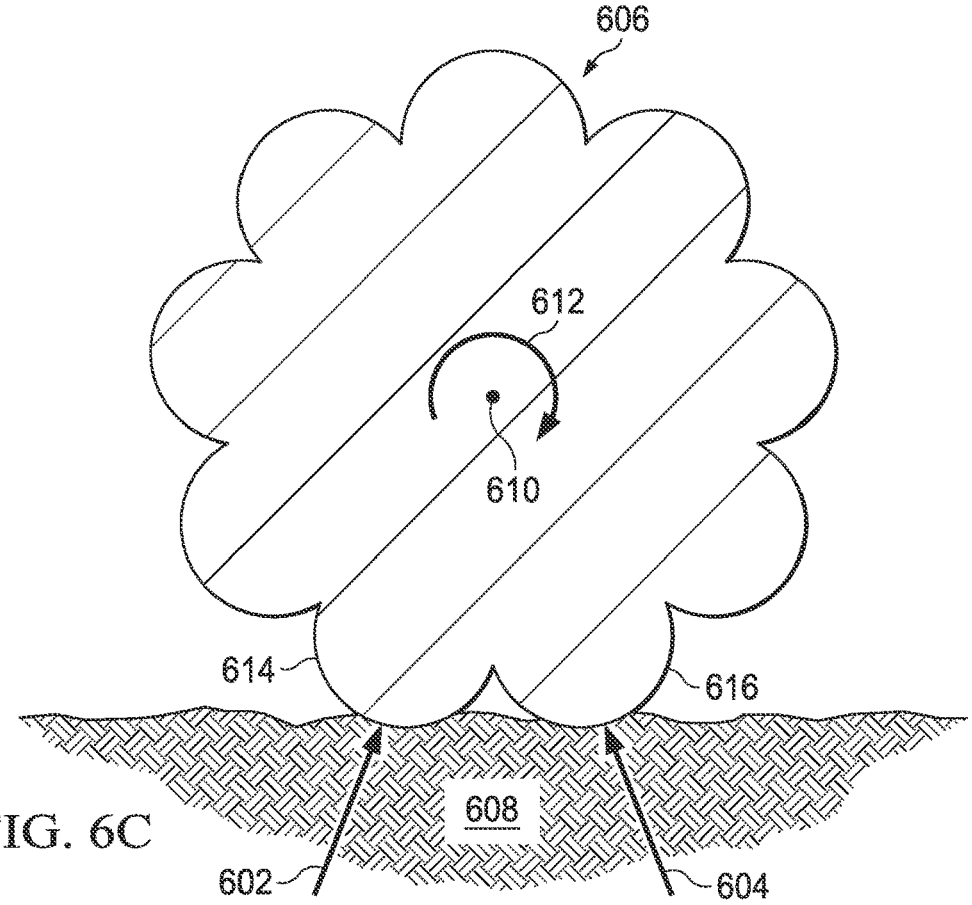
FIG. 6C illustrates a cross-sectional front view of a shaped cutting element drilling a downhole formation.

FIG. 6C illustrates a cross-sectional front view of a shaped cutting element drilling into a downhole formation. Inclusion of a shaped cutting element on a cutter may change the forces incurred by a cutter as compared to a cutter with a cutting element having a circular cross-section. Cutters having a shaped cutting element may experience non-zero torque due to asymmetrical radial forces. Specifically, a shaped cutting element may incur multiple radial forces because of multiple contacts with a formation. For example, for a shaped cutting element having a polygonal cross-section, each side of the shaped cutting element that contacts a formation may incur a radial force. Likewise, for a shaped cutting element having teeth, each tooth that contacts a formation may incur a radial force. These multiple contacts may promote rotation of a rotatable cutter about a cutter axis of the rotatable cutter. Because these radial forces may have varying forces and angles of incidence relative to a cutter axis of a cutter, the sum of these forces may generate torque around the cutter axis of the cutter. Torque around a cutter axis of a rotating cutter may cause the cutter to rotate in the direction of the torque.

As depicted in FIG. 6C, shaped cutting element 606 has a non-circular cross-section and includes tooth 614 and tooth 616. During drilling operations, formation 608 may have a non-planar surface. Accordingly, individual portions of shaped cutting element 606 may experience different radial forces. Tooth 614 may incur radial force 602, while tooth 616 may incur radial force 604. Radial forces 602 and 604 may vary based on contact between shaped cutting element 606 and formation 608. Because force 602 and force 604 may have different magnitudes and directions, the sum of these forces may result in torque 612 around cutter axis 610. Torque 612 may cause a rotatable substrate portion to rotate with respect to a fixed base portion. Thus, cutting element 606 may rotate due to interactions between a formation and shaped cutting element 606. Rotation of shaped cutting element 606 may allow different portions of shaped cutting element 606 to contact the formation at different times during a drilling operation. Accordingly, different portions of shaped cutting element 606 may wear more evenly during drilling operations than non-rotating cutting elements. Shaped cutting element 606 and cutter 600 may thus have a longer effective life and increase the efficiency of drilling operations.

During drilling operations, as a cutter interacts with different sections of a wellbore, the magnitude and directions of radial forces 602 and 604, incurred by tooth 614 and tooth 616, respectively, may vary. Thus, the magnitude and direction of torque 612 may vary during a drilling operation as shaped cutting element 606 interacts with different portions of a wellbore. Torque 612 may have either a positive or negative value. Accordingly, torque 612 may cause a rotatable cutter to rotate either clockwise or counterclockwise about a cutter axis. Additionally, radial forces 602 and 604 may vary as shaped cutting element 606 rotates, and/or as shaped cutting element 606 experiences wear.

Figure 7A:
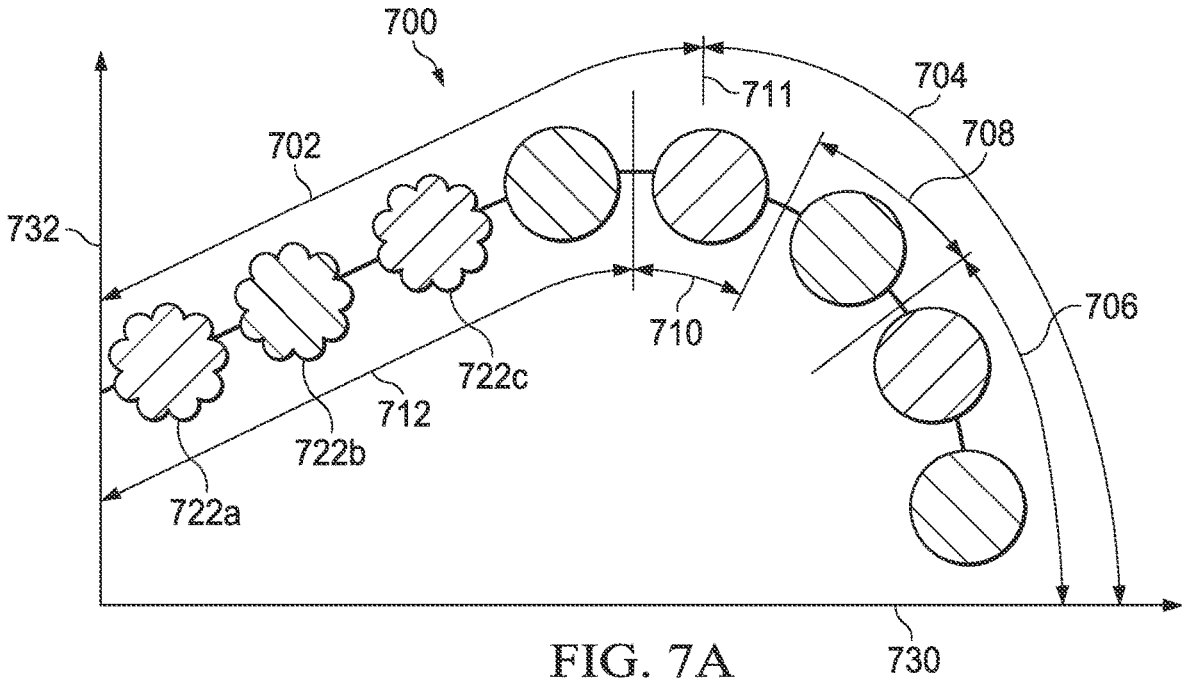
FIG. 7A illustrates blade profile that represents an upwardly pointed cross-sectional view of a blade of a drill bit.

FIG. 7A illustrates a blade profile that represents an upwardly pointed cross-sectional view of a blade of a drill bit. In addition to or in place of cutters with shaped cutting elements that are rotatably affixed to a drilling bit, cutters with shaped cutting elements (e.g., cutters 722*a*, 722*b*, and 722*c*) may be non-rotatably affixed to a drill bit. During drilling, non-rotatably affixed cutters with shaped cutting elements may interact with different sections of a wellbore, and thus may have different contact areas and arc-lengths with a formation. Varying contact areas and arc-lengths of non-rotatably affixed cutters may affect the application or effects of forces incurred by individual cutters and by a drill bit. Cutters including shaped cutting elements may be coupled to different zones of a drill bit to take advantage of properties of drilling forces incurred by shaped cutting elements.

For example, as shown in FIG. 7A, blade profile 700 includes cone zone 712, nose zone 710, shoulder zone 708, and gage zone 706 (as described in further detail above with reference to FIG. 3). Cone zone 712, nose zone 710, shoulder zone 708, and gage zone 706, may be identified based on their location along blade 202 with respect to bit axis 732 and horizontal reference line 730 that indicates a distance from bit axis 732 in a plane that includes bit axis 732. Blade profile 700 may include inner zone 702 and outer zone 704. Inner zone 702 may extend outward from bit axis 732 to nose point 711. Outer zone 704 may extend from nose point 711 to the end of blade 126. Nose point 711 may be the location on blade profile 700 within nose zone 710 that has maximum elevation as measured by bit axis 732 (vertical axis) from reference line 730 (horizontal axis). A coordinate on the graph in FIG. 7A corresponding to bit axis 732 may be referred to as an axial coordinate or position. A coordinate on the graph in FIG. 7A corresponding to reference line 730 may be referred to as a radial coordinate or radial position that indicates a distance extending orthogonally from bit axis 732 in a radial plane passing through bit axis 732. For example, in FIG. 7A bit axis 732 may be placed along a z-axis and reference line 730 indicates the distance (R) extending orthogonally from bit axis 732 to a point on a radial plane that may be defined as the ZR plane.

A drill bit may include one or more non-rotatable cutters having a shaped cutting element affixed to a drill bit. For example, as depicted in FIG. 7A, cutters 722*a*, 722*b*, and 722*c* may include shaped cutting elements. Cutters 722*a*, 722*b*, and 722*c* may be non-rotatably attached to a blade of a drill bit. One or more cutters with non-rotatable shaped cutting elements may be affixed in the cone zone of a drill bit. Cutters with non-rotatable shaped cutting elements may also be affixed to any suitable location on a drill bit, such as one or more cutters with non-rotatable shaped cutting elements in a shoulder zone, nose zone, or gage zone.

As described above with reference to FIGS. 6A and 6B, cutters may experience multiple forces as a shaped cutting element contacts a formation during drilling operations. For example, a penetration force may act in drilling direction of the cutter. Further, a drag force may act perpendicularly to penetration force. Drag forces and penetration forces may depend on rock compressive strength (σ) and the area of a cutting zone on a cutting face of a cutter. Drag forces may also depend on the shape of a cutting zone on a cutting face of a cutter. For example, under a given set of drilling parameters (e.g., rock compressive strength, RPM, ROP) smaller cutting zones may experience lower drag force and lower penetration force than larger cutting zones. The effects of the shape of a cutting zone on drilling forces may be estimated using shaped based cutting force equations. For example, a computer generated three dimensional model of a drill bit design may be utilized to determine the position of each cutter on a drill bit design. Based on the position of each cutter relative to other features on the drill bit design the cutting zone, the arc length (S), and the equivalent cutting height (H), may be determined for the cutting zone of each respective cutter. For example, cutting forces for cutters with cutting zones having other shapes may be calculated based on a shape-based cutting force equation:

$$F_c=\mu*\sigma*\xi*S^{\alpha}*H^{\gamma}$$

where μ is a coefficient related to back rake and side rake angles, σ is the rock compressive strength, ξ is a coefficient related to the cutting shape, S is the arc length of the cutting zone, and H is the equivalent cutting height of the cutting zone. Equivalent cutting height, H, may be calculated based on the arc length, S, and the cutting zone, A, as follows:

$$H=A/S$$

Figure 7B:
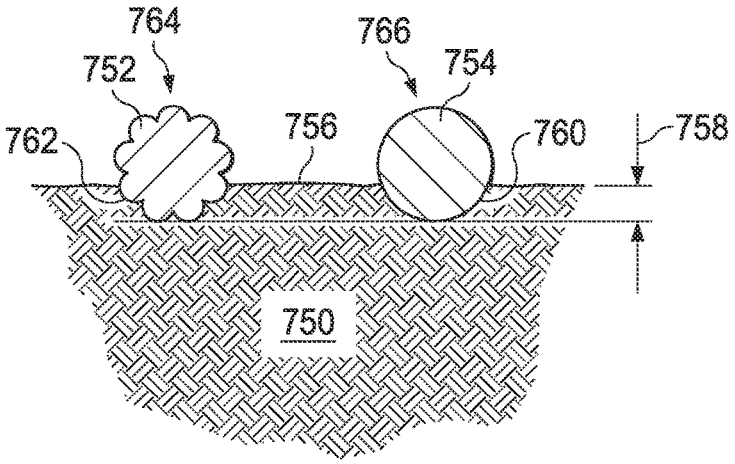
FIG. 7B illustrates a cross-sectional view of cutters interacting with a formation.

FIG. 7B illustrates a cross-sectional view of cutters interacting with a formation. Cutters having shaped cutting elements may have longer arc lengths, and thus may incur higher cutting forces. For example, cutter 764 includes a shaped cutting element 752, while cutting element 754 of cutter 766 has a circular cross-section. Formation 750 may include surface 756. In the example shown in FIG. 7B, shaped cutting element 752 and cutting element 754 have the same maximum penetration depth 758 into formation 750. The shortest distance between surface 756 and maximum penetration depth 758 may be referred to as depth of cut. As shown in FIG. 7B, shaped cutting element 752 has a longer arc contact length 762 with formation 702 than arc contact length 760 associated with cutting element 754. Accordingly, cutter 764 may incur higher cutting forces than cutter 766.

A drill bit or drill bit design may have one or more cutters with cutting elements having circular cross-sections and one or more cutters with cutting elements having non-circular cross-sections. Utilizing cutters with shaped cutting elements in the cone zone of drilling bit may take more WOB to achieve equivalent penetration forces to a drill bit utilizing non-shaped cutting elements. Similarly, for the same WOB, a drill bit including cutters with shaped cutting elements in the cone zone may create less TOB, thus allowing better tool face control.

Embodiments disclosed herein include:

A. A cutter for a drill bit, including a substrate for rotatably coupling to a body of the drill bit and a shaped cutting element secured to the substrate, the shaped cutting element having a radially symmetric, non-circular cross-section in a plane perpendicular to an axis of rotation of the substrate.

B. A drill bit including a bit body, a blade on an exterior portion of the bit body, and a rotating cutter on the blade. The rotating cutting including a substrate for rotatably coupling to a body of the drill bit and a shaped cutting element secured to the substrate, the shaped cutting element having a radially symmetric, non-circular cross-section in a plane perpendicular to an axis of rotation of the substrate.

C. A drill bit comprising a bit body a blade on an exterior portion of the bit body a first cutter coupled to the blade. The first cutter including a first substrate coupled to the blade, and a first cutting element on the substrate, the first cutting element having a radially symmetric, non-circular cross-section in a plane perpendicular to a cutter axis of the first cutter.

Each of embodiments, A, B, and C may have one or more of the following additional elements in any combination: Element 1: the cutter further comprising a base portion for fixing to the body of the drill bit, wherein the substrate is rotatably secured to the base portion. Element 2: wherein the base portion comprises a substrate material for bonding to the body of the drill bit. Element 3: wherein the base portion comprising the substrate material and the substrate rotatably secured to the base portion are generally aligned and have the same cross-sectional shape in a plane perpendicular to the axis of rotation of the substrate. Element 4: wherein the base portion further comprises a recess, the substrate positioned within the recess of the base portion. Element 5: wherein the cutter further comprises a retainer rotatably securing the rotating portion of the substrate in the recess of the portion of the substrate. Element 6: the cross-section of the shaped cutting element having a regular polygonal shape. Element 7: the cross-section of the shaped cutting element having a concave shape including a plurality of teeth. Element 8: each of the plurality of teeth having a circular shape. Element 9: the first cutter located on a cone zone of the blade. Element 10: a second cutter on the blade, the second cutter including a second substrate fixed to the blade, and a second cutting element on the second substrate, the second cutting element having a circular cross-section about a cutter axis of the second cutter.

Although the present disclosure and its advantages have been described in detail, it should be understood that various changes, substitutions and alternations can be made herein without departing from the spirit and scope of the disclosure as defined by the following claims. It is intended that the present disclosure encompasses such changes and modifications as fall within the scope of the appended claims.

What is claimed is:

1. A cutter for a drill bit, comprising:

a substrate for rotatably coupling to a body of the drill bit; and a shaped cutting element secured to the substrate, the shaped cutting element having a radially symmetric, non-circular cross-section in a plane perpendicular to an axis of rotation of the substrate, the cross-section of the shaped cutting element having a concave shape including a plurality of teeth, each of the plurality of teeth arranged contiguously with adjacent teeth around the shaped cutting element and having a uniformly circular shape between junctions with the adjacent teeth.

2. The cutter of claim 1, further comprising a base portion for fixing to the body of the drill bit, wherein the substrate is rotatably secured to the base portion.

3. The cutter of claim 2, wherein the base portion comprises a substrate material for bonding to the body of the drill bit.

4. The cutter of claim 3, wherein the base portion comprising the substrate material and the substrate rotatably secured to the base portion are generally aligned and have the same cross-sectional shape in a plane perpendicular to the axis of rotation of the substrate.

5. The cutter of claim 4, wherein:

the base portion further comprises a recess, the substrate positioned within the recess of the base portion; and wherein the cutter further comprises a retainer rotatably securing the rotating portion of the substrate in the recess of the portion of the substrate.

* * * * *